US005526619A

United States Patent [19]

Vagedes

[11] Patent Number: 5,526,619

[45] Date of Patent: Jun. 18, 1996

[54] TRIM ASSEMBLY FOR FINISHING A FIXTURE ON A BUILDING EXTERIOR

[75] Inventor: Michael Vagedes, Florence, Ky.

[73] Assignee: Richwood Building Products, Inc., Richwood, Ky.

[21] Appl. No.: 350,313

[22] Filed: Dec. 1, 1994

[51] Int. Cl.[6] ..... E04C 2/52

[52] U.S. Cl. ..... 52/220.1; 248/56

[58] Field of Search ..... 248/56, 27.1, 56; 285/46, 64; 52/220.1, 220.8

[56] References Cited

U.S. PATENT DOCUMENTS

| | | | |
|---|---|---|---|
| 3,889,909 | 6/1975 | Koscik | 248/56 |
| 4,081,915 | 4/1978 | Materniak et al. . | |
| 4,214,380 | 7/1980 | Meyer . | |
| 4,237,621 | 12/1980 | Boismenu . | |
| 4,726,152 | 2/1988 | Vagedes et al. . | |
| 4,860,791 | 8/1989 | Putnam | 248/56 X |
| 4,875,318 | 10/1989 | MacLeod et al. . | |
| 5,326,060 | 7/1994 | Chubb et al. . | |

*Primary Examiner*—Carl D. Friedman
*Assistant Examiner*—Creighton Smith
*Attorney, Agent, or Firm*—Wood, Herron & Evans

[57] ABSTRACT

A trim assembly for finishing a utility fixture extending through an exterior wall of a building. The trim assembly includes two base sections each having a cutout section for receiving one side of the utility fixture. The base sections are spread apart, slipped over the utility fixture and brought together around the utility fixture. The base is nailed to the building, and siding or another exterior is applied to the building and around the base. The trim assembly includes a trim cover which is mounted on the base sections to cover the interface between the siding and the base sections.

13 Claims, 2 Drawing Sheets

TRIM ASSEMBLY FOR FINISHING A FIXTURE ON A BUILDING EXTERIOR

FIELD OF THE INVENTION

The present invention relates generally to the area of construction accessories, and more particularly, to a trim assembly for finishing the interface between an exterior wall of a building and an element of a utility extending therethrough.

BACKGROUND OF THE INVENTION

In the construction of a building, for example, a residential building, it is most common to first construct rough flooring over footers or a foundation. Thereafter, the walls are framed; and the second story rough floor is constructed. The second floor framing is erected; the roof trusses are attached; and exterior sheeting is applied to the entire structure. A roof is installed, and the plumbing pipes and electrical wires are routed. When the electrical and water utilities are terminated through an exterior wall of the building, generally a rough hole is cut in the sheeting which is larger than the electrical box or pipe protruding therethrough. Further, in the case of a water supply pipe, a water valve or faucet will generally be connected to the end of the pipe.

When the exterior finish material, for example, wood siding, is applied over the sheeting, the profile of the water valve does not permit simply drilling a hole in the siding and sliding it over the protruding water pipe. Therefore, the siding must be carefully and skillfully cut with special tools and fitted around the pipe behind the faucet. Further, a caulk or other sealing material is applied between the pipe and the siding to prevent water from flowing back into the house. That process of fitting and sealing the siding around the electrical box or pipe is time consuming, expensive and often results in a less than desirable appearance.

SUMMARY OF THE INVENTION

To overcome the disadvantages described above, the present invention provides a trim assembly for finishing the interface between an exterior wall of a building and an element of a utility extending therethrough. With the trim assembly of the present invention, a plumbing or electrical fixture protruding through a rough side wall of a building is finished with a trim that is inexpensive, easy to use, and provides a very desirable finished appearance.

According to the principles of the present invention and in accordance with the described embodiments, the trim assembly includes two base sections. The two base sections are separated, then joined together to fit around the protruding pipe or electrical box and nailed in place to the sheeting. Areas of the base sections which are designed to be exposed have a high quality finish and provide a pleasing appearance when the trim assembly is installed. In addition, the base can be manufactured to tolerances so that when it is placed around the pipe or electrical box, it has the further advantage of impeding or resisting the flow of rain or other water back into the building. Each section of the base is a mirror image of the other section and includes a wall structure extending outwardly from the base a distance approximately equal to the thickness of the siding to be applied. When the base sections are brought into their mating position and attached to the structure, the walls of the base sections provide a continuous quadrilateral structure extending around the electrical box or pipe. Therefore, the base has the further advantage of allowing the siding to be fit up against the quadrilateral structure by trimming the siding with straight-line cuts. Consequently, there is a still further advantage in that special tooling and greater labor skills are not required; and further, the siding may be fit up to the base with simple cuts and in a minimal amount of time.

The base sections are joined along one edge with a thin piece of flexible material which operates as a hinge and permits the base sections to be more conveniently handled as a single piece.

The trim assembly further includes a trim cover that is slidably mounted over and interlocks with the walls projecting from the base. The trim cover includes a flange that extends outwardly from the body member in a direction generally parallel to the wall of the building. The flange is of sufficient width so as to overlap the siding and cover the interface or spacing between the siding and the base sections. The trim cover is finished so that it has a pleasing appearance and has the advantage of being attached to the base without requiring any tooling. Further, the interlocks between the trim cover and the base may be released so that the trim cover can be removed.

DETAILED DESCRIPTION OF THE INVENTION

Figure 1:
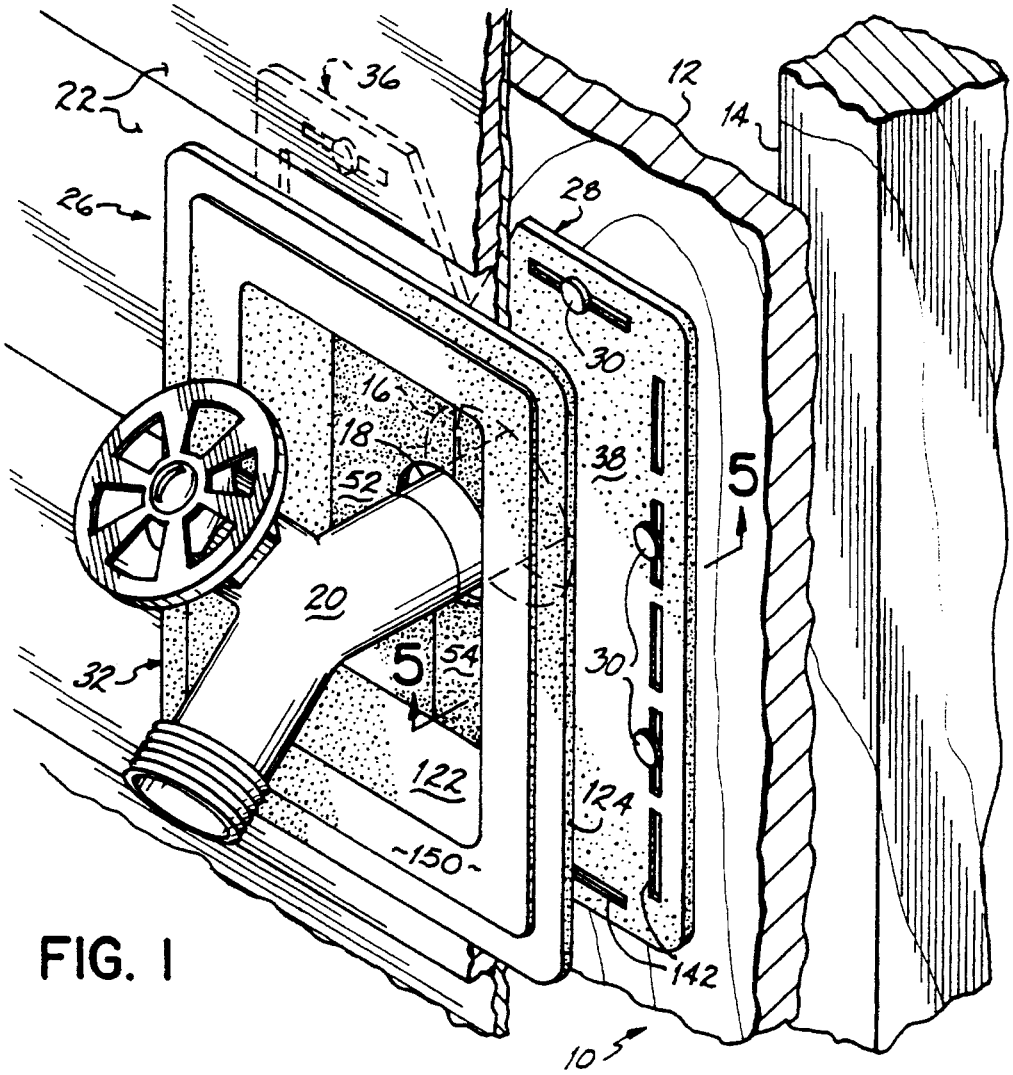
FIG. 1 is a perspective view of the fixture trimming cover as it is mounted on an exterior wall around a plumbing fixture.

Referring to FIG. 1, in the process of construction of a building 10, walls of exterior sheeting 12 are applied to support joists 14 to provide a rough exterior wall for the building 10. Electrical and plumbing utilities are then installed within the building 10 and are routed to the building exterior by cutting rough openings or holes 16 through the walls of sheeting 12. In the case of plumbing, as illustrated in FIG. 1, water pipes 18 are passed through the holes 16 in the sheeting 12 and are capped. The plumbing is inspected for leaks; and at some later point in time, the pipe 18 is terminated with a valve, for example, an outdoor faucet 20.

Thereafter, an exterior finish material, for example, wood siding 22 is attached to the exterior sheeting 12 by fasteners (not shown). The presence of the faucet 20 prohibit simply cutting a hole the size of the pipe 18 in the siding 22 and sliding the siding 22 over the pipe 18. Referring to FIG. 1, the trim assembly 26 of the present invention is shown as it is typically installed on a building structure 10. The trim assembly 26 includes a base 28 which is attached, for example, by nails 30 to the exterior sheeting 12. The siding 22 is cut and formed around the base 28 using simple straight line cuts. A trim cover 32 is then mounted on the base 28 and covers any spaces between the siding 22 and the base 28, thereby providing a pleasing finished appearance to the extension of the water pipe 18 and the faucet 20 extending through the exterior wall of siding 22 of the building 10.

Figures 2, 5:
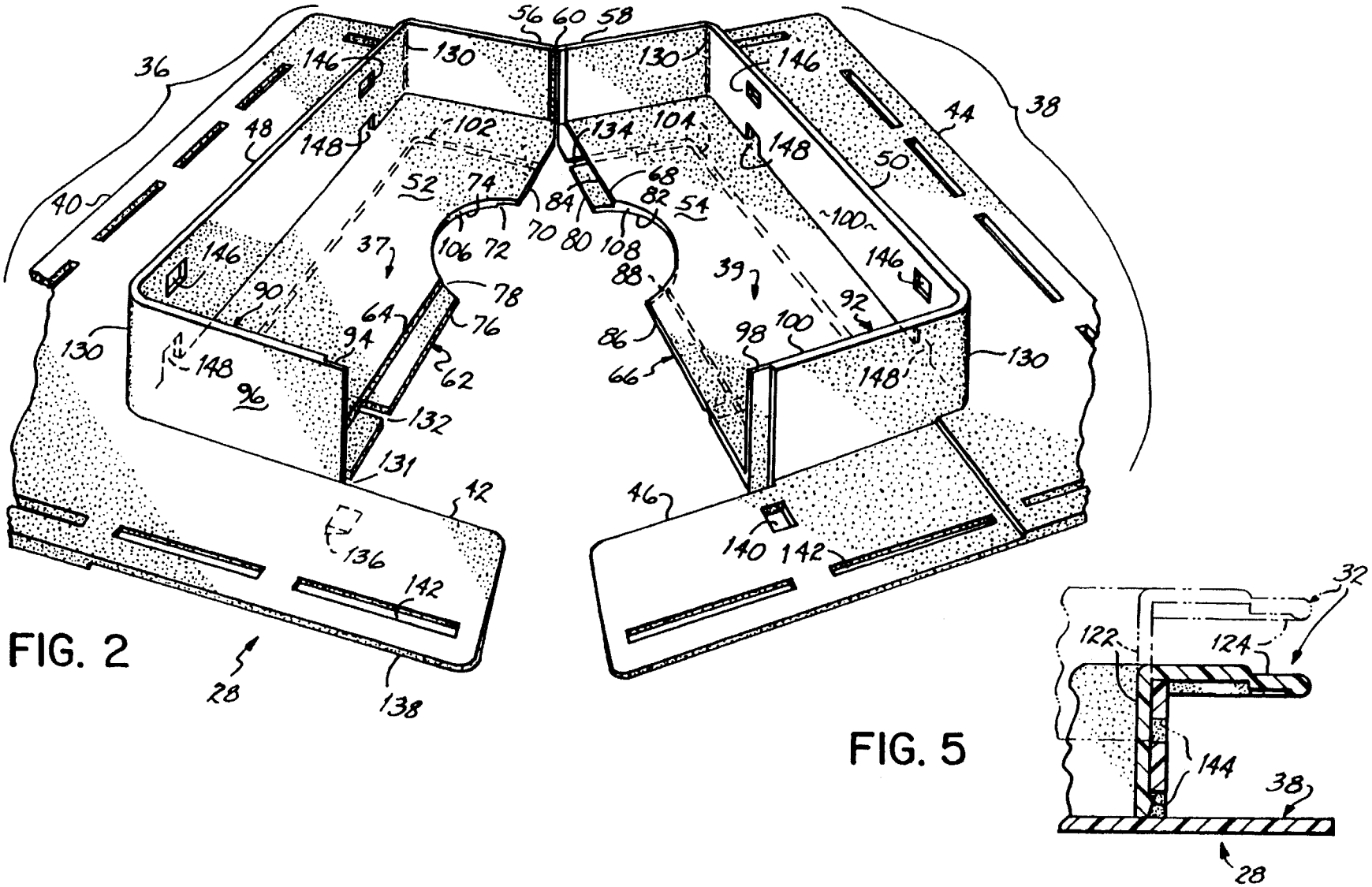
FIG. 2 is a perspective view of the base member illustrating the living hinge and overlapping relationship between the mating contiguous edges of the base member sections.
FIG. 5 is a cross-sectional view taken at lines 5—5 of FIG. 1 with the phantom lines showing element 32 in a raised position.

Referring to FIG. 2, the base 28 includes a left hand base section 36 and a right hand base section 38. The base sections 36, 38 are generally mirror images of each other. The base section 36 has a base plate 37 that includes a mounting flange 40 extending around its outer perimeter and bordering the base section 36. The mounting flange 40 has an outer, or front flange lip 42 that is approximately one-half the thickness of the flange lip 40. The base section 38 has a base plate 39 that includes a mounting flange section 44 that surrounds and borders the base section 38. The mounting flange section 44 includes an inner or rear flange lip 46 that is approximately one-half the thickness of the flange sections 40, 44. The base sections 36, 38 further include generally U-shaped wall sections 48, 50 that extend from outer directed surfaces 52, 54 of the respective base sections 36, 38 in a generally perpendicular direction. The walls 48, 50 are generally the same size and are located such that they have respective adjacent ends 56, 58, which are joined by a hinge, for example, a living hinge 60.

The base section 36 has an edge connector 62 extending along a fourth edge 64, which is next to a mating edge connector 66 extending along a fourth edge 68 of the base section 38. The edge connector 62 has a front or outer directed lip 70, which is contiguous with the surface 52 and has a thickness of approximately one-half of the thickness of the base section 36, thereby forming a corner 72 between the front lip 70 and a rear surface 74 of the base section 36. The edge connector 62 further includes a rear lip 76 contiguous with the rear surface 74, which is approximately one-half the thickness of the base section 36. The rear lip 76 forms a corner 78 between the rear lip 76 and the front surface 52 of the base section 36.

The edge connector 66 includes a rear lip 80, which is contiguous with a rear surface 82 of the base section 38. The rear lip 80 is approximately one-half the thickness of the base section 38 and forms a corner 84 between the rear lip 80 and the front surface 54 of the base section 38. The edge connector 66 further includes a front lip 86 approximately one-half the thickness of the base section 38 and contiguous with the front surface 54 of the base section 38. The front lip 86 forms a corner 88 between it and the rear surface 82 of the base section 38. The ends 90, 92 of the respective walls 48, 50 join together by means of a lap joint that is created by an outer flange 94 contiguous with an outer surface 96 of the wall 48 and is approximately one-half the thickness of the wall 48. The lap joint further comprises an inner lip 98 contiguous with an inner surface 100 of the wall 50 and approximately one-half the thickness of the wall 50. The inner surfaces 74, 82 of respective base sections 36, 38 contain respective grooves 102, 104 which are preferably, V-shaped and sized to surround the outside walls of an electrical junction box into which an electrical appliance, for example, a switch, a duplex socket, etc., is mounted. Consequently, if the base 28 is to be used with an electrical box, the portions of the base sections 36, 38 inside the grooves 102, 104 can be "knocked out" or removed to provide an opening in the base sections 36, 38 for receiving the electrical box. The base plate further includes generally semi-circular mating cut-out sections 106, 108, which are sized to fit around the pipe 18 illustrated in FIG. 1.

Figure 3:
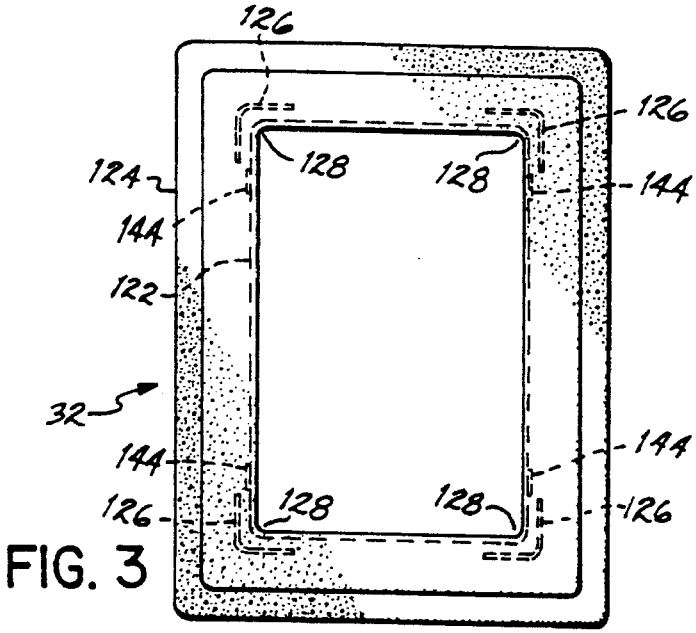
FIG. 3. is a view of the cover member.

Referring to FIG. 3, the trim assembly 26 includes a trim cover 32 comprised of a body member 122 and a flange 124. The body member 122 is sized to fit within the wall sections 48, 50 of the respective base sections 38, 36. The trim flange 124 extends outwardly from all sides of the trim body 122, and preferably, the trim flange 124 has a finish that is textured and pleasing in appearance. In addition, the trim cover 32 includes four angle brackets 126, which are positioned at the corners 128 of the trim body member 122. The angle brackets 126 are displaced from the corners 128 such that the corners 130 of the U-shaped wall sections 48, 50 can be located between the angle brackets 126 and the corners 128 of the trim body member 122. This helps to hold the U-shaped wall sections together. Preferably, the angle brackets 126 have a taper on their outer most portions which are close to the tabs 144 to facilitate moving the angle brackets past the U-shaped wall sections 48, 50.

In use, referring to FIG. 1, during the construction process, after the sheeting 12 has been applied to the building 10 and the electric and water utilities installed, which, in the case of water utilities includes the installation of the faucet 20, the base sections 36, 38 of the trim assembly 26 are spread apart so that they may be slipped past the faucet 20 and over the pipe 18 protruding from the sheeting 12. Thereafter, referring to FIG. 2, the ends 90, 92 of the walls 40, 50 of the base sections 36, 38 are brought together. In that process, the front lip 70 of edge connector 62 slides over the lip 80 of edge connector 66. The front lip 70 fits into corner 84, and the rear lip 80 fits into corner 72. Similarly, the lip 86 of edge connector 66 overlaps the lip 76 of edge connector 62. The front lip 86 fits into the corner 78, and the rear lip 76 fits into the corner 88. Further, the outer lip 94 overlaps the inner lip 98 as the ends 90, 92 of the respective walls 48, 50 are brought together. The clearance slot 131 provides clearance, if required, as the inner lip 98 slides over the outer lip 94. Further, clearance slots 132 and 134 provide clearance in the event that the knocked out sections 102, 104 are removed from the base 28. Further, as the ends 90, 92 are brought together, the front flange lip 42 of flange 40 slides over the rear flange lip 46 of flange section 44 until tab 136 on the rear surface 138 of front flange lip 42 engages the slot 140. With that tab-slot engagement, the front flange lip 42 is prevented from sliding in the opposite direction, thereby separating the ends 90, 92 of the base 28. The tab 136 can be disengaged from the slot 140 by lifting the front flange lip 42 and displacing it away from the rear flange lip 46. When the tab 136 is engaged in the slot 140, the outer directed edge of the front lip 70 is generally located immediately adjacent the corner 84, and the outer directed longitudinal edge of the front lip 86 is located within and adjacent to the corner 78 such that the front surfaces 52, 54 of the respective base sections 36, 38 are substantially coplanar. Similarly, the outer directed longitudinal edge of the lip 80 is located within and substantially adjacent to the corner 72; and the outer directed longitudinal edge of the rear lip 76 is located in and immediately adjacent to the corner 88 such that the rear surfaces 74, 82 of the respective base sections 36, 38 are substantially coplanar.

Figure 4:
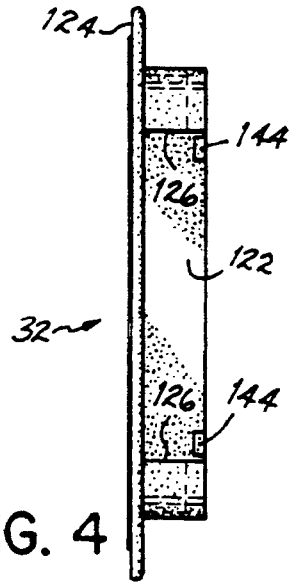
FIG. 4 is a partial cross-sectional view illustrating how the cover interlocks with the base to accommodate different siding thicknesses.

After the base sections 36, 38 are assembled as described above, nails or other fasteners are inserted through slots 142 to attach the base 28 to the sheeting 12. The semi-circular cut-out sections 106, 108 are sized such that they fit snugly around the pipe 18. After the base 28 is attached to the sheeting, the exterior finish material, such as wood siding, is installed. The siding is fit around the quadrilateral wall structure 48, 50 with simple straight line cuts. Thereafter, the trim cover 32 is positioned immediately above the base 28 such that its body member 122 is located inside the generally U-shaped walls 48, 50 of the base 28. With the trim cover 122 thus positioned, it is pushed over the base 28 until, as shown in FIG. 4, locking tabs 144 engage either the first set of slots 146, or the second set of slots 148. The two sets of slots 146, 148 are used to accommodate different thicknesses of the siding. With the trim cover 32 mounted in place and the locking tabs 144 engaged with slots 146 or 148, the attachment of the trim assembly to the building 10 is complete.

Therefore, the trim assembly of the present invention provides an interface or joint between a utility and the exterior wall of a building which is easily and quickly attached to the building. Further, the outer surface 150 (FIG. 1) of the trim cover 32 is textured so that it has a pleasing finished appearance. Further, the surfaces 52, 54 of the base 28 may also be textured to provide an attractive finished appearance. In addition, the edge connector 62, 66 provide rigidity along adjacent edges 64, 68 of the respective base sections 36, 38. The edge connectors 62, 66 also provide a tortuous path that rain or other water must execute in moving from the exterior side of the base 28 to its inner sides 74, 82 prior to having access to the hole 16 in the sheeting 22. Therefore, the edge connector 62, 66 make it difficult for rain or other water to enter the building 10. The trim cover 32 may be disengaged from the base 28 by disengaging the locking tabs 144 from their respective slots 146, 148.

While the invention has been set forth by a description of the embodiment in considerable detail, it is not intended to restrict or in any way limit the claims to such detail. Additional advantages and modifications will readily appear to those who are skilled in the art. For example, the U-shaped walls 48, 50 of respective base section 36, 38 are joined at ends 56, 58 by a hinge 60. The hinge is preferably molded with the base sections 36, 38 as a thin wall section extending between the ends 56, 58. Alternatively, the hinge may be otherwise manufactured, or further, the hinge may be eliminated; and the base sections 36, 38 manufactured as two separate pieces.

Further, while the molded base 28 and trim cover 32 are preferably made by an injection molding process from a polypropylene, or other thermoplastic material, other molding processes and other plastic or sheet metal materials may be used.

In addition, the edge connectors 62, 66 are recited as having a particular sequence of overlapping front and rear lips. As will be appreciated, other arrangements of overlapping lips, flanges, or other structures may be utilized. Similarly, the arrangement of the overlapping front and rear tabs may also be reversed. As an alternative embodiment, the base sections 36, 38 may be made without the edge connectors 62, 66; and the respective edges 64, 68 may be manufactured to form a butt joint therebetween. Further alternatively, since the base 28 is rigidly fastened to the sheeting 12, it is possible to eliminate the locking tab 136 and associated notch 140. Further, the overlapping front and rear flange lips 42, 46 of the respective flanges 40, 44 may be replaced by flange ends of full thickness which form a butt joint therebetween. In addition, although the corner angle brackets 126 provide additional rigidity and facilitate locating the trim cover over the corners 130 of the walls 48, 50 of base 28, such angle brackets may be deleted from the trim assembly without adversely affecting its function.

The invention, therefore, in its broadest aspect, is not limited to the specific details shown and described. Accordingly, departures may be made from such details without departing from the spirit and scope of the invention.

What is claimed is:

1. A construction accessory for trimming an interface between an exterior wall of a building and an element of a utility extending through the exterior wall, the construction accessory comprising:

a first base section including a first base plate having a first edge, and a continuous first wall extending outwardly from the first base plate, the continuous first wall having two ends terminating at the first edge;

a second base section including a second base plate having a second edge, and a continuous second wall extending outwardly from the second base plate, the continuous second wall having two ends terminating at the second edge; and a hinge connected between the first and second base sections to permit the first and second base sections to move with respect to each other from an open position to a closed position;

a cover member surrounding said first wall and said second wall when said accessory is in said closed position, and wherein said first and second base sections define an opening for an element of a utility when in said closed position.

2. The construction accessory of claim 1 wherein the hinge is connected to one of the ends of each of the first and second continuous walls of the respective first and second base sections.

3. The construction accessory of claim 2 wherein the first and second edges of the respective first and second base plates have opposed first and second openings, respectively, the first and second openings being shaped to encompass a first utility fixture in response to the first and second base sections moving toward each other to bring the first and second edges in juxtaposition.

4. The construction accessory of claim 2 wherein the first and second edges of the respective first and second base sections have opposed first and second knockout areas, respectively, the first and second knockout areas being shaped to encompass a second utility fixture in response to the first and second base sections moving toward each other to bring the first and second edges in juxtaposition.

5. The construction accessory of claim 2 wherein the first and second edges of the respective first and second base sections overlap in response to the first and second base sections moving toward each other to bring the first and second edges together.

6. The construction accessory of claim 2 wherein the first and second base sections include respective first and second mating interlocking elements, and the first and second interlocking elements engage and interlock in response to the first and second base sections moving toward each other to bring the first and second edges together.

7. The trim accessory of claim 1 wherein the first and second continuous walls have a generally constant height and extend in a generally perpendicular direction from the first and second base plates, respectively.

8. A construction accessory fixed to an exterior wall of a building, said building having an element of a utility extending through said exterior wall and through said accessory, the construction accessory comprising:

a first base section including a generally flat first plate fixed to said exterior wall of said building, the first plate having a first edge, and a generally U-shaped first wall section extending outwardly in a generally perpendicular direction from the first plate, the first wall section having an outer directed surface adjacent a surface of the exterior wall of the building;

a second base section including a generally flat second plate fixed to the exterior wall of the building, the second plate having a first edge, and a generally U-shaped second wall section extending outwardly in a generally perpendicular direction from the second plate, and the second wall section having an outer directed surface adjacent a surface of the exterior wall of the building, wherein said first wall section and said second wall section are held together by a living hinge wherein said first and second base plates define an aperture through which said element of said utility extends.

9. The building accessory of claim 8 further comprising:

a cover including a body member attached to the first and second U-shaped wall sections of the respective first and second base sections, and a flange extending outwardly from the body member in a direction generally parallel to sheeting and overlapping siding.

10. The of claim 8 wherein the first and second base sections further include respective first and second nailing strips, and wherein siding is mounted on the building so that an edge of the siding is fit adjacent an outer directed surface of the first and second walls of the respective first and second base sections covering said nailing strips.

11. The combination claimed in claim 8 wherein said utility is a water faucet.

12. A building accessory comprising:

a first base section having a first wall;

a second base section having a second wall, the second base section being hingedly connected to the first base section, and the second wall having first and second ends adapted to be contiguous with respective first and second ends of the first wall upon the first and second base sections being moved together; and a flange member adapted to engage the first and second walls upon the first and second base sections being moved together to provide a flange around the first and second walls.

13. A construction accessory for trimming an interface between an exterior wall of a building and an element of a utility extending through the exterior wall, the construction accessory comprising:

first and second base sections and a hinge connected between the first and second base sections to permit the first and second base sections to pivot with respect to each other about the hinge, the first base section having a first base plate with a first edge adapted to be adjacent a second edge of a second base plate of the second base section; and the first base section having a first wall extending outwardly from the first base plate, the first wall having a first end terminating at the first edge of the first base plate and a second end terminating at the hinge, said first base plate having a nailing strip outwardly of said first wall and a first inner base plate portion inwardly of said first wall; and the second base section having a second wall extending outwardly from the second base plate, the second wall having a first end terminating at the first edge of the second base plate and a second end terminating at the hinge, said second base plate section having a nailing strip outwardly of said wall and a second inner base plate portion inwardly of said second wall;

said first and second base plate portion defining an defining adapted to surround an element of a utility when said first edge of said first base plate section is adjacent said second edge of said second base plate section.

* * * * *